US007135450B2

(12) United States Patent
Maki et al.

(10) Patent No.: US 7,135,450 B2
(45) Date of Patent: Nov. 14, 2006

(54) FOAMY COMPOSITION FOR BLEACHING CLOTHING

(75) Inventors: Masataka Maki, Wakayama (JP); Kazuyoshi Ozaki, Wakayama (JP); Nobuyoshi Yamaguchi, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/522,166

(22) PCT Filed: Jul. 24, 2003

(86) PCT No.: PCT/JP03/09400

§ 371 (c)(1),
(2), (4) Date: Aug. 12, 2005

(87) PCT Pub. No.: WO2004/011583

PCT Pub. Date: Feb. 5, 2004

(65) Prior Publication Data

US 2006/0108561 A1 May 25, 2006

(30) Foreign Application Priority Data

Jul. 29, 2002 (JP) ..... 2002-220109

(51) Int. Cl.

| | |
|---|---|
| ***C11D 3/00*** | (2006.01) |
| ***C11D 3/39*** | (2006.01) |
| ***C11D 7/18*** | (2006.01) |
| ***C11D 7/54*** | (2006.01) |
| ***C11D 1/00*** | (2006.01) |

(52) U.S. Cl. ..... 510/309; 510/328; 510/535

(58) Field of Classification Search ..... 510/289, 510/291, 302, 303, 309
See application file for complete search history.

(56) References Cited

U.S. PATENT DOCUMENTS

| | | | | |
|---|---|---|---|---|
| 5,512,203 | A * | 4/1996 | Kolattukudy et al. | 510/392 |
| 5,833,719 | A * | 11/1998 | Francois et al. | 8/111 |
| 2005/0215449 | A1 * | 9/2005 | Penninger et al. | 510/267 |

FOREIGN PATENT DOCUMENTS

| | | | |
|---|---|---|---|
| JP | 02238098 | A * | 9/1990 |
| JP | 5-156293 | | 6/1993 |
| JP | 9-100492 | | 4/1997 |
| JP | 9-104898 | | 4/1997 |
| JP | 9-104900 | | 4/1997 |
| JP | 9-506130 | | 6/1997 |
| JP | 11-500778 | | 1/1999 |
| JP | 11-100594 | | 4/1999 |
| WO | 98/49386 | | 11/1998 |

* cited by examiner

*Primary Examiner*—Douglas McGinty
*Assistant Examiner*—John M. Petruncio
(74) *Attorney, Agent, or Firm*—Oblon, Spivak, McClelland, Maier & Neustadt, P.C.

(57) ABSTRACT

The invention provides an excellent means of giving an excellent bleaching effect when a liquid bleaching composition is used as foam. A liquid composition containing (a) hydrogen peroxide, (b) a specific sugar derivative-based surfactant, (c) polyoxyalkylene alkyl ether wherein the carbon number of the alkyl group is 10 to 14 and the mole number of oxyalkylene added on the average is 7 to 12, and (d) water in a specific ratio is foamed and used in bleaching of clothing.

16 Claims, 3 Drawing Sheets

FOAMY COMPOSITION FOR BLEACHING CLOTHING

FIELD OF THE INVENTION

The present invention relates to a foamed composition for bleaching clothing, a method of bleaching clothing, and a clothing bleaching agent contained in a container.

BACKGROUND OF THE INVENTION

An oxygen-based liquid bleaching agent containing hydrogen peroxide as a major base material can be used in colored/patterned clothes, and used preferably because of advantages such as direct applicability to stains. The oxygen-based liquid bleaching agent is usually used by a method of washing with it together with a weakly alkali detergent introduced into a washing machine, or by a method that involves applying it directly onto stains and then washing together with a weakly alkaline detergent in a washing machine, but the bleaching effect is still not satisfactory.

In a method of solving this problem, a liquid bleaching composition using specific two kinds of surfactants in combination with a bleaching activator is disclosed in JP-A 9-104898, JP-A 9-104900 and JP-A 9-100492.

On one hand, a bleaching agent charged into a trigger container for the sake of use is disclosed. JP-A 11-100594 discloses a clothing oxygen-based bleaching agent charged into a trigger container provided with a discharger having a specific foaming mechanism. JP-A (W) 11-500778 discloses a liquid composition containing a peroxide bleaching agent and a surfactant introduced into a spray-type dispenser. JP-A(W) 9-506130 discloses a peroxide compound-containing two-part detergent capable of spraying. Further, JP-A 5-156293 discloses an alkyl glucoside-containing bleaching agent for hard surface, and suggests that the bleaching agent can be fed in a foamed state with a spray container.

SUMMARY OF THE INVENTION

When a bleaching agent is applied to clothing, a method of applying it in a liquid form is usually used, but the present inventors found that the bleaching power and detergency of a bleaching agent are improved more by applying it in a finely foamed state than by the above method. In this respect, none of the publications supra suggest that the bleaching agent is allowed to adhere in a foamed state to clothing.

Accordingly, a purpose of the present invention is to provide a means of giving an excellent bleaching effect and a composition suitable therefor.

The present invention relates to a foamed composition for bleaching clothing, which is formed from a liquid composition containing 1 to 6% by mass of (a) hydrogen peroxide [hereinafter, referred to as component (a)], 0.5 to 10% by mass of (b) a compound of the following formula (1):

$$R^1—(OR^2)_xG_y \quad (1)$$

wherein $R^1$ represents a linear or branched C8 to C16 alkyl group, $R^2$ represents a C2 to C4 alkylene group, G represents a residue derived from reducing sugar, x is an average number of 0 to 6, and y is an average number of 1 to 10 [hereinafter, referred to as component (b)], 1 to 20% by mass of (c) polyoxyalkylene alkyl ether wherein the carbon number of the alkyl group is 10 to 14 and the mole number of oxyalkylene added is 7 to 12 on the average [hereinafter, referred to as component (c)], and (d) water [hereinafter, referred to as component (d)], wherein the ratio of the component (b)/component (c) by mass is from 1/10 to 2/1.

The present invention also relates to a method of bleaching clothing, which includes contacting, with clothing, foam formed from a liquid composition containing 1 to 6% by mass of the component (a), 0.5 to 10% by mass of the component (b), 1 to 20% by mass of the component (c) and the component (d), wherein the ratio of the component (b)/component (c) by mass is from 1/10 to 2/1.

Further, the present invention relates to a bleaching agent for clothing, containing a liquid composition charged into a container provided with a discharger having a foaming mechanism, said liquid composition containing 1 to 6% by mass of the component (a), 0.5 to 10% by mass of the component (b), 1 to 20% by mass of the component (c) and the component (d), wherein the ratio of the component (b)/component (c) by mass is from 1/10 to 2/1.

Furthermore, the present invention relates to a liquid bleaching composition for clothing, containing 1 to 6% by mass of the component (a), 0.5 to 10% by mass of the component (b), 1 to 20% by mass of the component (c) and the component (d), wherein the ratio of (b)/(c) by mass is from 1/10 to 2/1.

In any of the compositions described above, $R^1$ is preferably a linear alkyl group.

DETAILED DESCRIPTION OF THE INVENTION

<Liquid Composition>

[Component (a)]

The liquid composition of the present invention contains hydrogen peroxide as component (a) in an amount of 1 to 6 wt %, preferably 1 to 5 wt %, more preferably 1.5 to 4.5 wt %. In this range, an excellent bleaching effect can be achieved.

[Component (b)]

The liquid composition of the present invention contains the compound of the following formula (1) as component (b). The component (b) is excellent in that it is stable to the component (a), exhibits sufficient foaming even in the presence of the component (c) in the composition, and provides fine-grained foam.

$$R^1—(OR^2)_xG_y \quad (1)$$

wherein $R^1$ represents a linear or branched C8 to C16, preferably C10 to C16, more preferably C10 to C14 alkyl group, $R^2$ represents a C2 to C4 alkylene group, preferably an ethylene group or propylene group, particularly an ethylene group, G represents a residue derived from reducing sugar, x is an average number of 0 to 6, preferably 0 to 3, more preferably 0, and y is an average number of 1 to 10, preferably 1 to 5, more preferably 1 to 2.

G is a residue derived from reducing sugar, and the reducing sugar as the starting material may be either aldose or ketose and may include triose, tetrose, pentose and hexose, which have 3 to 6 carbon atoms, respectively. Specifically, the aldose includes apiose, arabinose, galactose, glucose, lyxose, mannose, aldose, idose, talose and xylose, and the ketose includes fructose. In the present invention, aldopentose and aldohexose having 5 or 6 carbon atoms, respectively, are preferable, among which glucose is more preferable.

The compound of formula (1) can be easily synthesized by acetalation reaction or ketalation reaction of the reducing sugar with $R^1$—$(OR^2)_x$—OH by using an acid catalyst. In the case of acetalation reaction, it may be a hemiacetal structure or a usual acetal structure.

The liquid composition of the present invention contains the component (b) in an amount of 0.5 to 10 wt %, preferably 1 to 8 wt %, more preferably 1.5 to 5 wt %.

[Component (c)]

The liquid composition of the present invention contains polyoxyalkylene alkyl ether wherein the carbon number of the alkyl group is 10 to 14 and the mole number of oxyalkylene added is 7 to 12 on the average, and more specifically the polyoxyalkylene alkyl ether is preferably at least one member selected from compounds of the following formula (2) and compounds of the following formula (3). The mole number of oxyalkylene added on the average is 7 or more in respect of foaming or 12 or less in respect of the stability of foam, that is, difficulty in breaking foam.

$$R^3—O—(C_2H_4O)_a—H \quad (2)$$

wherein $R^3$ represents a C10 to C14 alkyl group, a is a number of 7 to 12, preferably 8 to 10.

$$R^4—O—(C_2H_4O)_b—(C_3H_6O)_c—H \quad (3)$$

wherein $R^4$ represents a C10 to C14 alkyl group, b and c independently represent a number of 2 to 12, b+c is a number of 7 to 12, preferably 8 to 10, and ethylene oxide and propylene oxide may be in a random or block adduct.

The component (c) is a reagent which is originally not desired to be blended because it inherently breaks foam. However, the component (c) is an important component for increasing bleaching power and detergency or for stabilizing a component (e) described later in the case where the component (e) is blended.

The liquid composition of the present invention contains the component (c) in an amount of 1 to 20 wt %, preferably 2 to 15 wt %, more preferably 4 to 12 wt %.

The liquid composition of the present invention further contains the component (b)/component (c) in a ratio of 1/10 to 2/1, preferably 1/8 to 1/1, more preferably 1/5 to 4/5, and the bleaching effect of the foamed composition upon adhering to clothing can be significantly improved by satisfying this range.

[Other Components]

The liquid composition of the present invention is in the form of an aqueous solution (including a dispersed state) having the components (a) to (c) dissolved in water as component (d), and for storage stability, water used is preferably deionized water or distilled water from which a very small amount of dissolved metal was removed. The content of water as component (d) in the liquid composition is preferably 70 to 98 wt %, more preferably 80 to 95 wt %.

The pH of the liquid composition of the invention at 20° C. is preferably 0 to 7, more preferably 1 to 6.5, still more preferably 2 to 5, further more preferably 2 to 4. The pH regulator used in adjustment to such pH is preferably an acid, for example an inorganic acid such as hydrochloric acid and sulfuric acid, an organic acid such as citric acid, succinic acid, malic acid, fumaric acid, tartaric acid, malonic acid and maleic acid or an alkali such as sodium hydroxide, potassium hydroxide, ammonia or derivatives thereof, an amine salt such as monoethanol amine, diethanol amine and triethanol amine, sodium carbonate and potassium carbonate, or a combination thereof, particularly preferably an acid selected from hydrochloric acid and sulfuric acid or an alkali selected from sodium hydroxide and potassium hydroxide.

The viscosity of the liquid composition of the invention at 20° C. is preferably in the range of 3 to 100 mPa·s, more preferably 4 to 60 mPa·s, in order to give preferable foam. For adjustment to such viscosity, a viscosity regulator can be blended in the present invention. The viscosity regulator used includes benzene sulfonic acid which may be substituted with one to three C1 to C3 alkyl groups or hydroxyl groups, polyethylene glycol or polypropylene glycol having a weight-average molecular weight of 3,000 to 100,000, a sugar-based polymer compound selected from xanthane gum, guar gum and carboxymethyl cellulose, a nonionic surfactant having a C12 to C20, preferably C14 to C18, alkyl or alkenyl group and a polyoxyethylene chain wherein the mole number of oxyethylene added on the average is 60 to 200, preferably 100 to 200, and a reaction product of the nonionic surfactant with a diepoxy compound such as vinyl cyclohexene diepoxide. The content of the viscosity regulator in the liquid composition is preferably 0 to 10 wt %, more preferably 0.01 to 5 wt %.

For the purpose of improving the bleaching effect, the liquid composition of the present invention preferably contains a bleaching activator as component (e), which is preferably an alkanoyloxy benzene-based bleaching activator, more preferably alkanoyloxy benzene sulfonic acid having a C8 to C14, preferably C8 to C13, alkanoyl group, or alkanoyloxy benzene carboxylic acid having a C8 to C14, preferably C8 to C13, alkanoyl group, or salts thereof. More specific examples include octanoyloxy-p-benzene sulfonic acid, nonanoyloxy-p-benzene sulfonic acid, 3,5,5-trimethylhexanoyloxy-p-benzene sulfonic acid, decanoyloxy-p-benzene sulfonic acid, dodecanoyloxy-p-benzene sulfonic acid, octanoyloxy-o- or -p-benzene carboxylic acid, nonanoyloxy-o- or -p-benzene carboxylic acid, 3,5,5-trimethylhexanoyloxy-o- or -p-benzene carboxylic acid, decanoyloxy-o- or -p-benzene carboxylic acid, dodecanoyloxy-o- or -p-benzene carboxylic acid, and salts thereof. The salts are preferably sodium salts, potassium salts and magnesium salts, among which sodium salts are particularly preferable in respect of solubility.

Among these, nonanoyloxy-p-benzene sulfonic acid, decanoyloxy-p-benzene carboxylic acid, dodecanoyloxy-p-benzene sulfonic acid and salts thereof are preferable in respect of bleaching effect. When the component (e) is contained, the component (c) acts as a stabilizer. Particularly when an alkanoyl benzene sulfonic acid- or alkanoyl benzene carboxylic acid-based bleaching activator is used as the component (e), the component (c) is an important component for preventing the influence of the component (a). (The stability is enhanced by further compounding the component (f).) In this case, the component (b) is an important component for foaming.

The liquid composition of the present invention contains the component (e) in an amount of preferably 0.1 to 5 wt %, preferably 0.2 to 3 wt %, more preferably 0.4 to 1 wt %.

When the liquid composition of the present invention contains the component (e), a cationic surfactant and/or an amphoteric surfactant [referred to hereafter as component (f)] is contained preferably for the purpose of improving the stability of the component (e) in the composition.

The cationic surfactant is preferably a compound of the following formula (4):

(4)

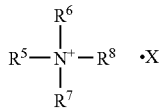

wherein $R^5$ is a C8 to C18, preferably C10 to C18, more preferably C10 to C16, alkyl or alkenyl group, $R^6$, $R^7$ and $R^8$ are the same or different and each represent a C1 to C3 alkyl group, $X^-$ is an anion, preferably a C1 to C3 alkyl sulfate ion, a C1 to C12 fatty acid ion, an aryl sulfonate ion which may have one to three C1 to C3 substituent groups, particularly preferably a C1 to C3 alkyl sulfate ion.

The amphoteric surfactant is preferably a compound of the following formula (5):

(5)

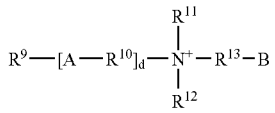

wherein $R^9$ is a C9 to C23, preferably C9 to C17, more preferably C9 to C15, alkyl or alkenyl group, $R^{10}$ is a C1 to C6, preferably C2 or C3, alkylene group, A is a group selected from —COO—, —CONH—, —OCO—, —NHCO—, and —O—, d is a number of 0 or 1, each of $R^{11}$ and $R^{12}$ is a C1 to C3 alkyl or hydroxyalkyl group, $R^{13}$ is a C1 to C5, preferably C1 to C3, alkylene group which may be substituted with a hydroxyl group, and B is a group selected from $—COO^-$, $—SO_3^-$, and $—OSO_3^-$.

The liquid composition of the present invention contains the component (f) in an amount of preferably 0 to 2 wt %, more preferably 0.1 to 1 wt %, still more preferably 0.2 to 0.6 wt %. In respect of the storage stability of the component (e), the component (e)/component (f) ratio by mass is preferably 1/15 to 5/1, more preferably 1/10 to 2/1, still more preferably 1/3 to 3/2.

For the purpose of improving the detergent effect, the liquid composition of the present invention can contain an anionic surfactant as the component (g). The anionic surfactant is preferably an anionic surfactant having a C10 to C18, preferably C10 to C16, more preferably C10 to C15, alkyl or alkenyl group and a $—SO_3M$ group and/or $—OSO_3M$ group (M: counterion) in the molecule thereof. Preferable examples include alkyl benzene sulfonic acid containing carbon atoms whose number is described above, alkyl (or alkenyl) sulfate, polyoxyalkylene alkyl (or alkenyl) ether sulfate wherein the mole number of alkylene oxide added on the average is 1 to 6, olefin sulfonic acid, alkane sulfonic acid, α-sulfofatty acid, α-sulfofatty ester and salts thereof. Among these, it is particularly preferable to compound at least one member selected from alkyl (or alkenyl) sulfate having a C10 to C16 alkyl or alkenyl group, polyoxyethylene alkyl (or alkenyl) ether sulfate having a C10 to C16 alkyl or alkenyl group wherein the mole number of ethylene oxide (referred to hereinafter as EO) added on the average is 1 to 6, preferably 1 to 4, more preferably 1 to 3, or C10 to C15 alkyl benzene sulfonic acid, and salts thereof. The salts are preferably sodium salts, potassium salts, ammonium salts and alkanol amine salts.

The composition of the present invention contains the component (g) in an amount of preferably 0 to 5 wt %, more preferably 0.5 to 4 wt %, still more preferably 1 to 3 wt %.

For the purpose of improving the bleaching effect, the liquid composition of the present invention preferably contains a dispersant [referred to hereinafter as component (h)]. The component (h) is preferably a carboxylic acid-based polymer selected from polyacrylic acid or a salt thereof and polymethacrylic acid or a salt thereof having a weight-average molecular weight of 5,000 to 40,000, preferably 5,000 to 10,000, and an acrylic acid/maleic acid copolymer having a weight-average molecular weight of 10,000 to 100,000, preferably 30,000 to 70,000 or a salt thereof, or a nonionic polymer selected from polyethylene glycols having a weight average molecular weight of 4,000 to 20,000, preferably 5,000 to 10,000.

The liquid composition of the present invention contains the component (h) in an amount of preferably 0.05 to 14 wt %, more preferably 0.1 to 8 wt %.

For the purpose of improving the bleaching effect, the liquid composition of the present invention preferably contains a solvent [referred to hereinafter as component (i)]. The component (i) is preferably (1) C1 to C5 monovalent alcohol, (2) C2 to C12 polyvalent alcohol, (3) a compound represented by formula (6) below, (4) a compound represented by formula (7) below, or (5) a compound represented by formula (8) below.

(6)

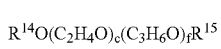

(7)

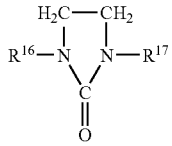

(8)

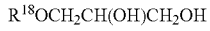

wherein $R^{14}$ and $R^{15}$ each represent a hydrogen atom, a C1 to C6 alkyl group, a phenyl group or a benzyl group, provided that $R^{14}$ and $R^{15}$ are not simultaneously hydrogen atoms; e is a number of 0 to 10, and f is a number of 0 to 10, provided that e and f are not simultaneously 0; $R^{16}$ and $R^{17}$ each represent a C1 to C3 alkyl group; and $R^{18}$ represents a C1 to C8 alkyl group.

The C1 to C5 monovalent alcohol (1) includes usually ethanol, propyl alcohol and isopropyl alcohol. By incorporating these lower alcohols, the stability of the system at low temperatures can be further improved.

The C2 to C12 polyvalent alcohol (2) includes isoprene glycol, 2,2,4-trimethyl-1,3-pentanediol, 1,8-octanediol, 1,9-nonanediol, ethyleneglycol, propyleneglycol, diethylene glycol, dipropylene glycol, glycerin etc.

The compound (3) is a compound of formula (6) wherein each of $R^{14}$ and $R^{15}$ when representing an alkyl group is particularly preferably a C1 to C4 alkyl group. In formula (6), e or f, representing the mole number of EO(ethyleneoxide) or PO(propylene oxide) added on the average, is a number of 0 to 10, provided that e and f are not simultaneously 0, and the order of addition of of EO(ethyleneoxide) and PO(propylene oxide) is not particularly limited, and these units may be added at random. Specific examples of the compound (3) include ethylene glycol monobutyl ether, dipropylene glycol dimethyl ether, diethylene glycol monoethyl ether, diethylene glycol monobutyl ether, propylene glycol monomethyl ether, propylene glycol monobutyl ether, propylene glycol monoethyl ether, propylene glycol dimethyl ether, polyoxyethylene (p=2 to 3) polyoxypropylene (p=2 to 3) glycol dimethyl ether (p represents the mole number of the unit added on the average; this definition applies hereinafter), polyoxyethylene (p=3) glycol phenyl ether, phenyl carbitol, phenyl cellosolve, benzyl carbitol etc. In respect of detergency and feeling in use, propylene glycol monomethyl ether, diethylene glycol monobutyl ether, polyoxyethylene (p=1 to 4) glycol monophenyl ether are preferable.

Preferable examples of the compound (4) include 1,3-dimethyl-2-imidazolidinone and 1,3-diethyl-2-imidazolidinone, and the compound (5) includes alkyl glyceryl ether compounds, preferably a compound of formula (8) wherein $R^{18}$ is a C3 to C8 alkyl group.

To meet the properties of the present invention, water soluble solvents among the compounds (1), (2), (3) and (5) are preferable, and particularly preferable among these is a solvent selected from ethanol, isopropyl alcohol, ethylene glycol, propylene glycol, diethylene glycol, dipropylene glycol, glycerin, isoprene glycol, propylene glycol monomethyl ether, propylene glycol monoethyl ether, pentyl glyceryl ether, octyl glyceryl ether and polyoxyethylene (p=1 to 4) glycol monophenyl ether.

The composition of the present invention preferably contains the component (i) in the amount of 0 to 3% by mass, preferably 0.1 to 2% by mass.

For the purpose of improving the bleaching effect, the liquid composition according to the present invention preferably contains a sequestering agent [referred to hereinafter as component (j)]. The component (j) used in the present invention includes (1) phosphoric acid-based compounds such as phytic acid or alkali metal salts or alkanol amine salts thereof, (2) phosphonic acid such as ethane-1,1-diphosphonic acid, ethane-1,1,2-triphosphonic acid, ethane-1-hydroxy-1,1-diphosphonic acid and derivatives thereof, ethane hydroxy-1,1,2-triphosphonic acid, ethane-1,2-dicarboxy-1,2-diphosphonic acid, methane hydroxy phosphonic acid or alkali metal salts or alkanol amine salts, (3) phosphonocarboxylic acid such as 2-phosphonobutane-1,2-dicarboxylic acid, 1-phosphonobutane-2,3,4-tricarboxylic acid and α-methylphosphosuccinic acid or alkali metal salts or alkanol amine salts thereof, (4) amino acid such as aspartic acid, glutamic acid and glycine or alkali metal salts or alkanol amine salts thereof, (5) aminopolyacetic acid such as nitrilotriacetic acid, iminodiacetic acid, ethylene diamine tetraacetic acid, diethylene triamine pentaacetic acid, glycol ether diamine tetraacetic acid, hydroxyethyl iminodiacetic acid, triethylene tetramine hexaacetic acid, diene colic acid or alkali metal salts or alkanol amine salts thereof, (6) organic acids such as diglycolic acid, oxydisuccinic acid, carboxymethyloxysuccinic acid, citric acid, lactic acid, tartaric acid, oxalic acid, malic acid, oxydisuccinic acid, gluconic acid, carboxymethylsuccinic acid and carboxymethyl tartaric acid or alkali metal salts or alkanol amine salts thereof, (7) alkali metal salts or alkanol amine salts of aluminosilicic acid represented by zeolite A, and (8) aminopoly(methylene phosphonic acid) or alkali metal salts or alkanol amine salts thereof, or polyethylene polyamine poly(methylene phosphonic acid) or alkali metal salts or alkanol amine salts thereof.

Among those described above, at least one member selected from the group consisting of (2), (5), (6) and (7) described above is preferable, and at least one member selected from the group (2) described above is more preferable.

In the present invention, the content of the component (j) in the liquid composition is preferably 0.005 to 5% by mass, more preferably 0.01 to 2% by mass.

In addition, the liquid composition of the present invention may be blended suitably with a fluorescent whitener such as Cinopearl CBS (Ciba-Geigy Co.), Cinopearl SWN (Ciba-Geigy Co.) and a color index fluorescent whiteners 28, 40, 61, 71 etc. for increasing the bleaching effect on bleached fibers, and with enzymes (cellulase, amylase, protease, lipase) for improving the bleaching performance. Colorants such as dyes and pigments and a wide variety of trace additives such as perfumes, silicones, sterilizers and UV absorbers may be incorporated in a suitable amount.

Figure 1:
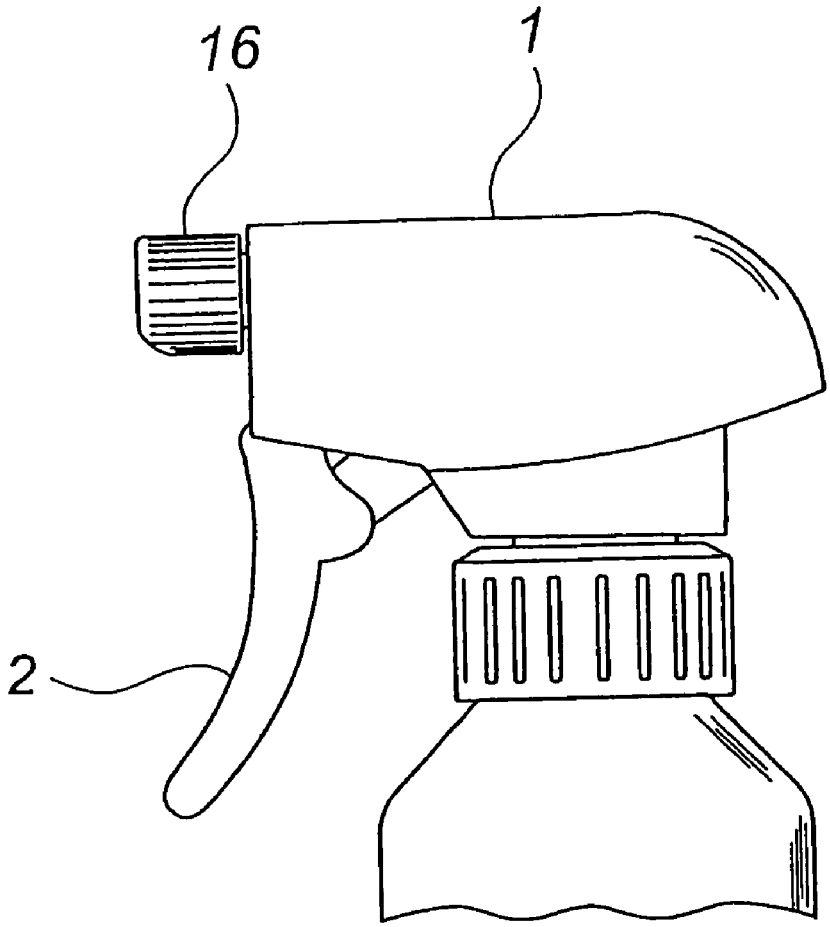
FIG. 1 shows one example of the trigger spray container used in the present invention.

25: liquid jet outlet
26: nozzle
28: rotating flow jetting device
29: linear flow jetting device
35: cylindrical buffer wall
36: air stream inlet
40: screen
42: penetration hole
310: foam discharging container
311: container body
313: gas/liquid mixing part
**313*b***: porous film
315: nozzle part
318: discharge opening
**318*a***: porous film
X: foam discharge passage
Y: air returning passage <A foam composition, a clothing bleaching agent charged in a container, and a bleaching method>

The foam composition of the present invention consists of foam from the liquid composition and a gas (typically air). Particularly, the term "foamed" refers to a state where the apparent volume per unit mass of the composition upon adhering to an objective surface is increased twice or more because of bubbles contained therein, and the apparent volume increased twice or more is maintained even after 1 minute.

The average diameter of bubbles constituting the foamed composition is preferably 1 to 10000 μm, more preferably 10 to 5000 μm, still more preferably 100 to 3000 μm. The viscosity of the foamed composition at 20° C. is preferably 3 to 100 mPa·s, more preferably 3 to 80 mPa·s, still more preferably 4 to 60 mPa·s.

For forming such a foamed composition and bringing it into contact with clothing, there is a method wherein a soft, breathable and pliable material (for example, sponge, cloth, nonwoven fabric etc.) capable of retaining a solution is impregnated with the liquid composition and foamed by rubbing with hands, and the foam is rubbed onto clothing, or a method of foaming by a mechanism of foaming by incorporation of air into the liquid composition upon being discharged with a pump or by squeeze (referred to hereinafter as foaming mechanism). Accordingly, a container equipped with a discharge mean having the foaming mechanism is used.

The container having the foaming mechanism, particularly the trigger spray container, is preferably a pressure-accumulative spray container provided with a jetting body 1 which can be fitted into the container and having a head 16 provided with a foam-jetting nozzle at the front wherein liquid is pressurized with a trigger 2, as shown in FIG. 1.

Figure 2:
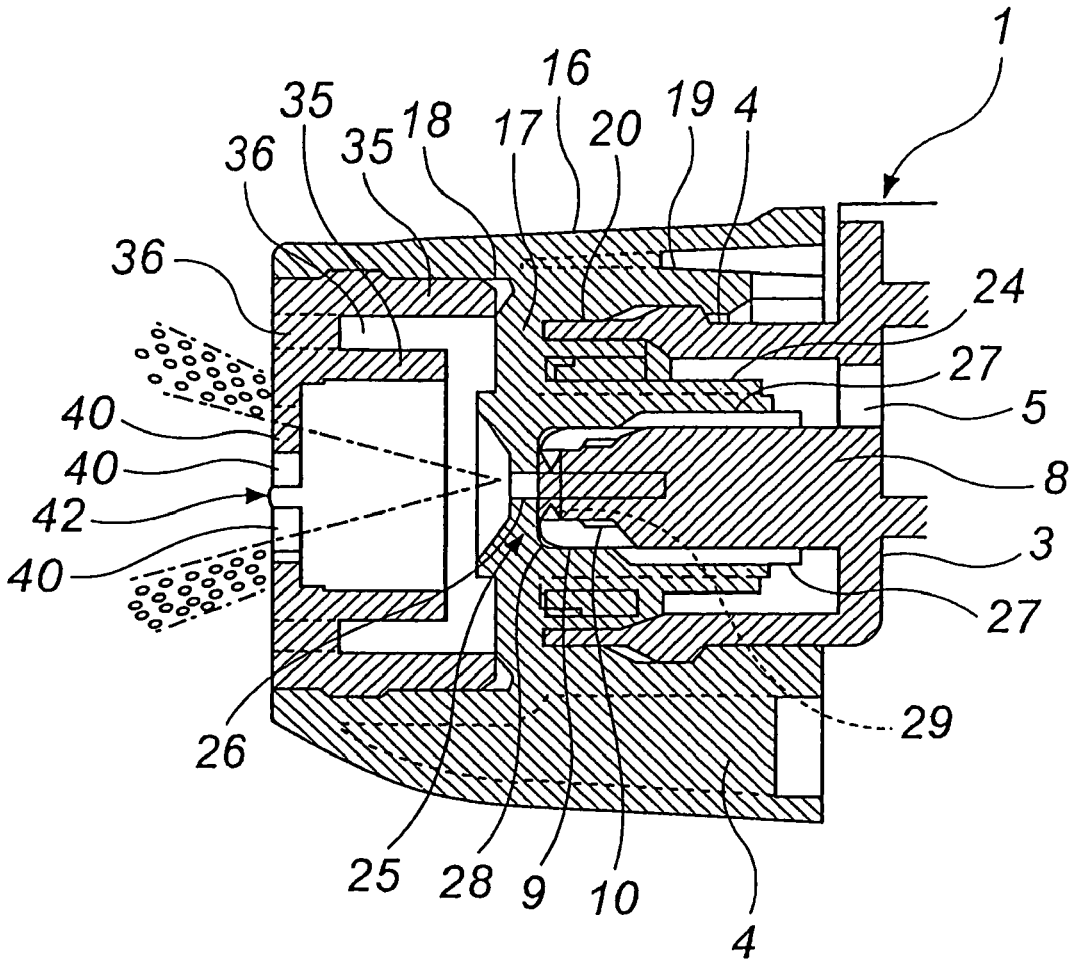
FIG. 2 is a sectional view of a foamer in the trigger spray container.

In this spray container as shown in FIG. 2, a plate body 3 made of synthetic resin is fitted into the front of the spray container body 1, and the plate body 3 is provided with a cylindrical protruding part 4, and the outer periphery of the cylindrical protruding part 4 is provided with an annular convex for fitting. In the plate body 3, a cylindrical part 8 slightly shorter than the cylindrical protruding part 4 is extended in the position of the center of the cylindrical protruding part 4.

The plate body 3 inside of the cylindrical protruding part 4 is provided with a liquid bung-hole passage 5 communicating with a bung hole in a pump mechanism not shown in the figure. As shown in FIG. 2, a linear flow passage 10 in the form of a longitudinal groove is arranged opposite the outer periphery at the top of the cylindrical part 8, and a rotating flow passage 9 is arranged outside the linear flow passage 10.

Opposite the outer periphery at the top of the cylindrical part 8, the rotating flow passage 9 is arranged in a position sliding by 60° in the circumferential direction from the part where the linear flow passage 10 and rotating flow passage 9 are arranged. Head 16 rotatable around, and fitted with, the cylindrical part 8 is made of synthetic resin and provided with a top plate 17 in the center slightly near the front, the top plate 17 is provided backward with a cylindrical part 19, an annular concave into which the annular convex arranged in the outer periphery of the cylindrical protruding part 4 is fitted is arranged in the inside of the cylindrical part 19, and an annular groove 20 is arranged in the inside of the basal part of the cylindrical part 19.

The top plate 17 inside of the cylindrical part 19 is provided backward with a cylindrical part 24, and the cylindrical part 24 is fitted closely and rotatably into the cylindrical part 8, and as shown in FIG. 2, a liquid passage 27 communicating with a liquid bung-hole passage 5 of the plate body 3 is arranged in the inside of the cylindrical part 24.

Nozzle 26 in a liquid jet outlet 25 is arranged in the center of the top plate 17 inside of the cylindrical part 24, and as shown in FIG. 2, the top plate 17 is provided the rotating flow jet passage 28 and linear flow jet passage 29 which are opposite to each other.

In the position shown in FIG. 2, the rotating flow jet passage 28 and linear flow jet passage 29 in the backside of the top plate 17 are formed so as to communicate respectively with the rotating flow passage 9 and linear flow passage 10 in the cylindrical part 8. The rotating flow passage 9 and the rotating flow jet passage 28 communicating with the rotating flow passage 9, the linear flow jet passage 29 communicating with the linear flow passage 10, and nozzle 26, form liquid jet outlet 25.

Circular concave 18 whose center is coincident with the center of the nozzle 26 is arranged in the front of the top plate 17 in the head 16, and an annular concave is arranged in the inside of the peripheral wall of the circular concave 18. Cylindrical buffer wall 35 made of synthetic resin is fitted into the circular concave 18, and an annular convex formed on the outer periphery of the cylindrical buffer wall 35 engages the annular concave of the circular concave 18, and the cylindrical buffer wall 35 is fitted into the circular concave 18, and the front of the nozzle 26 is enclosed with the cylindrical buffer wall 35.

The cylindrical buffer wall 35 is provided with an air inflow passage 36 arranged in the longitudinal direction on the outer periphery part, and the internal surface at the end of the cylindrical buffer wall 35 is provided with five screens 40 protruding toward the center of the cylindrical buffer wall 35. The screen 40 is formed in such a length as not to reach the center of the cylindrical buffer wall 35, and a penetration hole 42 is formed among the tips of five screens 40 and at the position of the center of the cylindrical buffer wall 35.

The container body is charged with a liquid composition, and when a pump mechanism not shown in the figure is actuated by operating the trigger 2, the liquid passes through from the liquid bung-hole passage 5 via liquid passage 27 and sent to the rotating flow passage 9 and linear flow passage 10, and delivered from the rotating flow passage 9 to the rotating flow jet passage 28 arranged in the head 16, or delivered from the linear flow passage 10 to the linear flow jet passage 29 arranged in the head 16.

A rotating stream is jetted out from the rotating flow jet passage 28, and a linear stream is jetted out from the linear flow jet passage 29, and the stream is jetted out as droplets through the nozzle 26. The jetted droplets are scattered by colliding with the screens 40. The spray droplets scattered by collision are mixed with other spray droplets and simultaneously mixed with air inhaled through air inflow passage 36 to form very fine droplets to be jetted out from a hollow space 43 and penetration hole 42 to the outside of the cylindrical buffer wall 35.

The spray stream jetted to the center of the cylindrical buffer wall 35 advances vigorously forward through the penetration hole 42 without being prevented by screen 40 from passing, thus accelerating the speed of the foam proceeding forward in the hollow space 43 and jetting out the foam vigorously without foam dripping.

When the liquid composition has low viscosity, for example a viscosity of 3 to 100 mPa·s at 20° C., a continuous flow of liquid is smooth, that is, a sufficient flow amount and a sufficient flow rate of the liquid can be achieved in each passage.

As a result, rich and creamy foam can adhere directly to clothing as the object of washing.

As an apparatus for mechanical foaming other than the apparatus in FIGS. 1 and 2, an apparatus having a porous film in a discharge passage can be mentioned. The porous film can be exemplified by for example sponge, sintered body, net etc. A thin net is preferably used particularly because when a liquid composition adhering to and remaining on the porous film is dried and solidified to cause clogging, its solid can be dissolved immediately by flow of foam upon next discharge, to dissolve the clogging. In this case, the mesh of the net is preferably 50 to 500 mesh, more preferably 150 to 400 mesh. By using a net having a mesh size in this range, creamy foam can be formed. Preferable materials of such mesh can be exemplified by nylon, polyester etc. Specifically, the apparatus can be exemplified by a foam discharge mechanism shown in FIG. 3.

Figure 3:
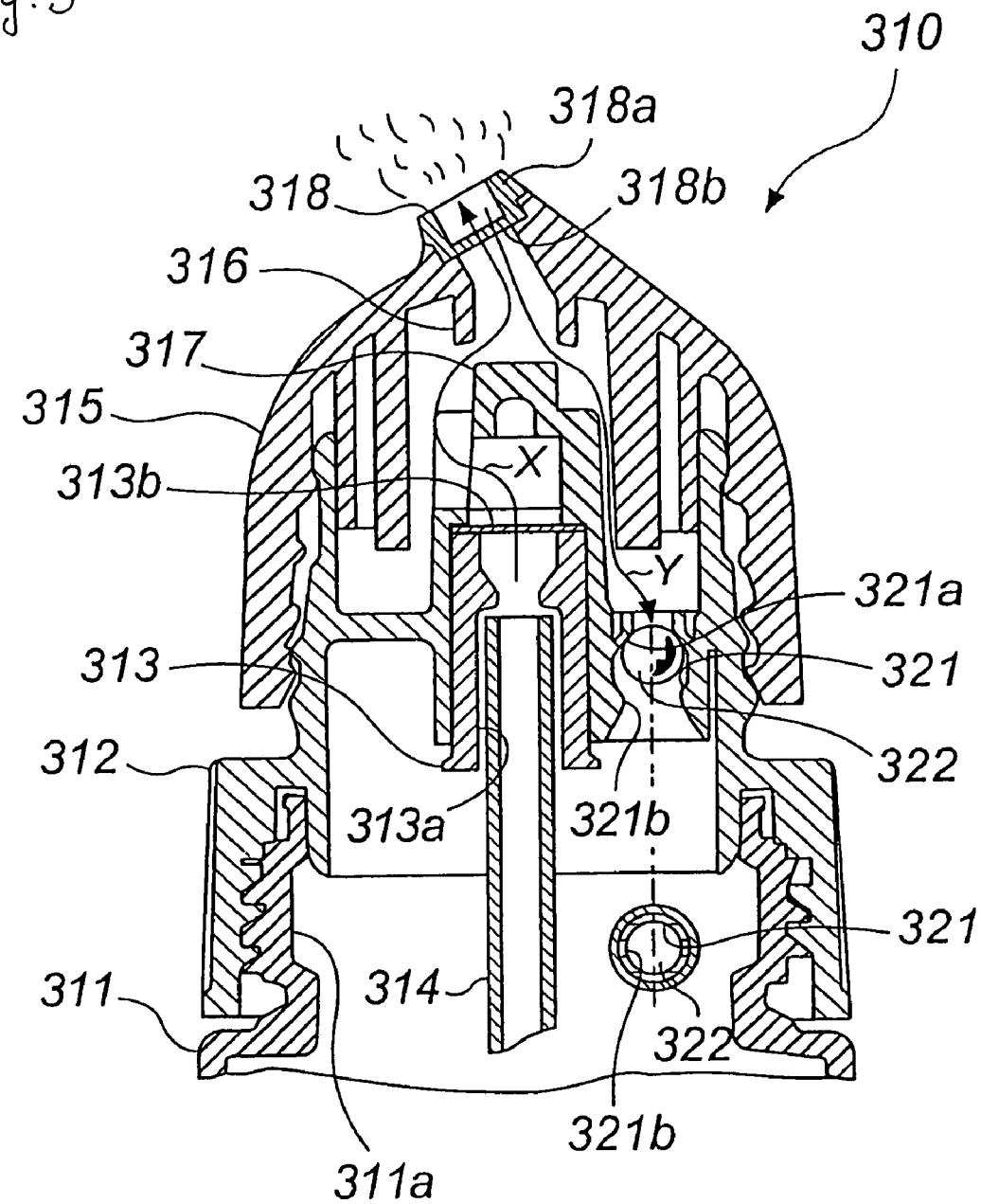
FIG. 3 is a partial enlarged sectional view of the foam discharging container used in the present invention. Symbols in the drawings are as follows.

In a foam discharging container 310 in FIG. 3, cap 312 is threadably attached to an opening 311*a* of a squeezable container body 311, and a gas/liquid mixing part 313 is arranged in the central position in the cap 312. The gas/liquid mixing part 313 is structured by arranging a tube connecting part 313*a* and porous film 313*b*.

In the foam discharging container 310, a dip tube 314 is fitted, with a predetermined gap, into the tube connecting part 313*a* of the gas/liquid mixing part 313, to communicate with the gas/liquid mixing part 313, and is supported by cap 312 and inserted into the container body 311. A freely opening and closing nozzle part 315 is threadably attached to the discharge side (upper side of the figure) of the gas/liquid mixing part 313 of the cap 312, and the nozzle part 315 is switched at a closed position and at an opened position by rotating it by 90° relative to cap 312. In the closed position, a sealing part 316 protruding in an annular form in the nozzle part 315 sticks to a plug part 317 positioned over the gas/liquid mixing part 313, and in the opened position, the sealing part 316 is apart from the plug part 317 to form a discharge passage. A porous film fixture 318*a* and porous film 318*b* are arranged at the top of a discharge opening 318 in the nozzle part 315, and the porous film 318*b* is fitted and fixed by the porous film fixture 318*a*.

In the foam discharging container 310, a ball valve 322 is arranged in an air returning passage 321 in cap 312, and the ball valve 322 sticks to a sealing portion 321*a* above the air returning passage 321 upon discharging foam, so that the inner pressure in the container body 311 is increased by squeezing. After discharge of foam, the ball valve 322 is locked with a protruding part 321*b* below the air returning passage 321, and external air is introduced into the container body 311 by the negative pressure in the container attributable to the container restoration force of the container body 311 upon relieving squeezing. The foam discharging container 310 discharges foam by the following working.

(1) By rotating the nozzle part 315, the sealing part 316 in the nozzle part 315 is separated from the plug part 317 in the cap 312, to form a foam discharge passage indicated by arrow X in FIG. 1.

(2) The container body 311 is squeezed by hands, whereby air (or liquid) introduced directly into the gas/liquid mixing part 313 in the cap 312 and liquid (or gas) introduced via dip tube 314 into the gas/liquid mixing part 313 are mixed and passed through the porous film 313*b* thereby forming foam, and the foam is discharged from the discharge opening 318 via the foam discharge passage X and through the porous film 318*b* arranged at the top of the discharge opening 318 in the nozzle part 315. Simultaneously, the ball valve 322 sticks to the sealing part 321*a* in the air returning passage to increase the pressure in the container body 311.

(3) After foam is discharged, the ball valve 322 is locked with the protruding part 321*b* in the air returning passage 321, and external air is introduced into the container body 311 through the air returning passage indicated by arrow Y in FIG. 3 by the negative pressure in the container attributable to the container restoration force of the container body 311 upon relieving squeezing. Simultaneously, external air will also pass through the reverse passage of the foam discharge passage X in the above item (2), but is resisted by the residual foam in the porous film 318*b*, thus passing through the air returning passage Y described above. When the introduction of air into the air returning passage Y is resisted considerably by the residual foam in the porous film 318*b*, the air returning passage 321 and the ball valve 322 may be arranged in such a position as to communicate directly with the outside of cap 312.

Examples of the trigger sprayer having a foaming mechanism include triggers having a discharger described in JP-A 11-100594 and Japanese Utility Model No. 3044068, and reference can also be made to JP-A 2000-185247, JP-A 2001-334178, JP-A 2002-20266, JP-A 7-256162, JP-A 8-71463, JP-A 9-285746, JP-A 10-85637, Japanese Utility Model Application Laid-Open (JP-U) No. 7-9451 and JP-U 7-9452.

A squeeze foamer can be exemplified by those described in JP-U 58-174272, JP-U 62-42787 and JP-B 52-16567, and a pump foamer discharging foam by pressing the head of a cap having a pump mechanism with a finger can be exemplified by those described in JP-U 3-7963 and JP-U 62-103458.

Thus, a clothing bleaching agent containing the liquid composition charged into a container provided with a discharger having a foaming mechanism is obtained according to the present invention.

For the purpose of achieving a high bleaching effect, the amount of the adhering liquid composition is 0.1 to 1 g/cm$^2$, preferably 0.1 to 0.5 g/cm$^2$. The time of contacting the foamed composition with clothing is 1 to 600 minutes, more preferably 3 to 300 minutes, still more preferably 5 to 60 minutes. After such treatment, the clothing is washed together with a conventional weakly alkaline detergent.

EXAMPLES

<Formulation Ingredients>

The ingredients used in the following examples are as follows:

a-1: hydrogen peroxide b-1: alkyl polyglucoside (the carbon number of the alkyl group, 12; degree of condensation of glucoside on the average, 1.3)

c-1: polyoxyethylene lauryl ether (mole number of EO added on the average, 8)

c'-1: polyoxyethylene lauryl ether (mole number of EO added on the average, 6)

d-1: deionized water e-1: sodium lauryloxy-p-benzene sulfonate f-1: N-dodecyl-N,N,N-trimethyl ammonium methyl sulfate g-1: C11 to C15 alkyl benzene sulfonic acid h-1: poly(sodium acrylate) (weight-average molecular weight 10, 000)

i-1: diethylene glycol monobutyl ether j-1: Dequest 2010 (trade name) [1-hydroxyethylidene-1,1-diphosphonic acid manufactured by Monsanto]

k-1: polyoxyethylene stearyl ether (mole number of EO added on the average, 150)

Example 1

A liquid composition having a pH value of 2.5 (adjusted with 1/10 N aqueous sulfuric acid and 1/10 N aqueous sodium hydroxide) at 20° C., containing 4 wt % component a-1, 4 wt % component b-1, 8 wt % component c-1, 1 wt % component e-1, 0.7 wt % component f-1 and 0.3 wt % component j-1, the balance being d-1, was prepared. This liquid composition was charged into a trigger container obtained from a commercial detergent charged into a trigger container (family sink cleaner manufactured by Kao Corporation, 0.8 g was jetted out by one stroke to form foam referred to in the present invention) by removing the detergent, washing the empty trigger container several times with water and drying it. This liquid composition in the trigger container was used to evaluate its bleaching effect by a method shown below. The bleaching effect of the liquid composition applied through a syringe without using the trigger container was also determined in an analogous manner. The results are shown in Table 1.

<Evaluation Method>

The foamed composition was sprayed from the container and applied in an amount of 0.8 g onto each of 4 clothes stained with a meat source prepared below, then left at 20° C. for 5 minutes, washed (80 rpm×10 minutes) with 0.0667 wt % commercial detergent solution in Tergötometer, rinsed with tap water, dried and examined for the degree of bleaching according to the equation below. The degree of bleaching of the 4 clothes on the average is shown in Table 1.

Degree of bleaching (%)=(reflectance after bleaching −reflectance before bleaching)/(reflectance of the white cloth −reflectance before bleaching)×100

The reflectance was measured by using a 460 nm filter in NDR-10DP manufactured by Nippon Denshoku Industries Co., Ltd.

(Preparation of the Stained Cloth)

From a meat source manufactured by Kagome Co., Ltd. (mature tomato meat source which is a canned product with 259 g content), solids were removed with a mesh (openings, 500 μm), and the resulting liquid was heated until it boiled. A cotton metal cloth #2003 was dipped in this liquid and boiled for about 15 minutes. After heating was terminated, the cloth was left therein and cooled for about 2 hours to room temperature, and the cloth was removed, and after an excess of the liquid adhering thereto was removed with a spatula, the cloth was air-dried. Thereafter, the cloth was pressed and used as a 10 cm×10 cm test cloth in the experiment.

Comparative Example 1

The same evaluation as in Example 1 was conducted except for using a composition wherein the component b-1 had been replaced by the component c-1. The result is shown in Table 1.

TABLE 1

| | | | Degree of bleaching (%) |
|---|---|---|---|
| Example 1 | Product of the invention | Trigger was used (cloth coated with foam) | 74 |
| | Comparative product | Syringe was used (cloth coated with the solution) | 58 |
| Comparative example 1 | Comparative product | Trigger was used (cloth coated with foam) | 62 |
| | Comparative product | Syringe was used (cloth coated with the solution) | 60 |

Examples 2 and Comparative Examples 2 to 4

Each of the liquid compositions shown in Table 2 was introduced into the trigger container in Example 1, and evaluated for the bleaching effect in the same manner as in Example 1. The results are shown in Table 2. In Example 2 and Comparative Example 2, each liquid composition was foamed by the trigger, while each composition in Comparative Examples 3 and 4 was not foamed.

TABLE 2

| | | | Example | Comparative example | | |
|---|---|---|---|---|---|---|
| | | | 2 | 2 | 3 | 4 |
| Liquid composition | Composition (mass-%) | a-1 | 4 | 4 | 4 | 4 |
| | | b-1 | 4 | 9 | 0.4 | 4 |
| | | c-1 | 8 | 4 | 8 | |
| | | c'-1 | | | | 8 |
| | | e-1 | 1 | 1 | 1 | 1 |
| | | f-1 | 0.4 | 0.4 | 0.4 | 0.4 |
| | | j-1 | 0.3 | 0.3 | 0.3 | 0.3 |
| | | d-1 | balance | balance | balance | balance |
| | | Total | 100 | 100 | 100 | 100 |
| | pH(20° C.) | | 2.5 | 2.5 | 2.5 | 2.5 |
| | Component (b)/component (c) ratio by mass | | 0.5 | 2.25 | 0.05 | 0.5 |
| | Degree of bleaching (%) | | 80 | 52 | 63 | 65 |

The invention claimed is:

1. A foamed composition for bleaching clothing, which is formed from a liquid composition comprising (a) 1 to 6% by mass of hydrogen peroxide, (b) 0.5 to 10% by mass of a compound of the following formula (1):

$$R^1—(OR^2)_xG_y \quad (1)$$

wherein $R^1$ represents a linear or branched C8 to C16 alkyl group, $R^2$ represents a C2 to C4 alkylene group, G represents a residue derived from a reducing sugar, x is an average number of 0 to 6, and y is an average number of 1 to 10, (c) 1 to 20% by mass of polyoxyalkylene alkyl ether, wherein the carbon number of the alkyl group is 10 to 14 and the mole number of oxyalkylene added on the average is 7 to 12, and (d) water, wherein the ratio of (b)/(c) by mass is from 1/10 to 2/1.

2. A method of bleaching clothing, comprising:

contacting, with clothing, foam formed from a liquid composition comprising (a) 1 to 6% by mass of hydrogen peroxide, (b) 0.5 to 10% by mass of a compound of the following formula (1):

$$R^1—(OR^2)_xG_y \quad (1)$$

wherein $R^1$ represents a linear or branched C8 to C16 alkyl group, $R^2$ represents a C2 to C4 alkylene group, G represents a residue derived from a reducing sugar, x is an average number of 0 to 6, and y is an average number of 1 to 10, (c) 1 to 20% by mass of polyoxyalkylene alkyl ether, wherein the carbon number of the alkyl group is 10 to 14 and the mole number of oxyalkylene added on the average is 7 to 12, and (d) water, wherein the ratio of (b)/(c) by mass is from 1/10 to 2/1.

3. A bleaching agent for clothing, comprising:

a liquid composition charged into a container provided with a discharger having a foaming mechanism, said liquid composition comprising (a) 1 to 6% by mass of hydrogen peroxide, (b) 0.5 to 10% by mass of a compound of the following formula (1):

$$R^1—(OR^2)_xG_y \quad (1)$$

wherein $R^1$ represents a linear or branched C8 to C16 alkyl group, $R^2$ represents a C2 to C4 alkylene group, G represents a residue derived from a reducing sugar, x is an average number of 0 to 6, and y is an average number of 1 to 10, (c) 1 to 20% by mass of polyoxyalkylene alkyl ether, wherein the carbon number of the alkyl group is 10 to 14 and the mole number of oxyalkylene added on the average is 7 to 12, and (d) water, wherein the ratio of (b)/(c) by mass is from 1/10 to 2/1.

4. A liquid bleaching composition for clothing, comprising:

(a) 1 to 6% by mass of hydrogen peroxide, (b) 0.5 to 10% by mass of a compound of the following formula (1):

$$R^1—(OR^2)_xG_y \quad (1)$$

wherein $R^1$ represents a linear or branched C8 to C16 alkyl group, $R^2$ represents a C2 to C4 alkylene group, G represents a residue derived from a reducing sugar, x is an average number of 0 to 6, and y is an average number of 1 to 10, (c) 1 to 20% by mass of polyoxyalkylene alkyl ether wherein the carbon number of the alkyl group is 10 to 14 and the mole number of oxyalkylene added on the average is 7 to 12, and (d) water, wherein the ratio of (b)/(c) by mass is from 1/10 to 2/1.

5. The foamed composition according to claim 1, wherein $R^1$ is a linear alkyl group.

6. The foamed composition according to claim 1, wherein said reducing sugar is an aldose or a ketose.

7. The foamed composition according to claim 1, wherein said reducing sugar is glucose.

8. The foamed composition according to claim 1, wherein said liquid composition has a pH of 0 to 7.

9. The foamed composition according to claim 1, wherein said liquid composition has a viscosity of from 3 to 100 mPas at 20° C.

10. The foamed composition according to claim 1, wherein said liquid composition further comprises a viscosity regulator.

11. The foamed composition according to claim 1, wherein said liquid composition further comprises (e) 0.1 to 5 wt. % of a bleaching activator.

12. The foamed composition according to claim 1, wherein said liquid composition comprises at least one member selected from the group consisting of nonanoyloxy-p-benzene sulfonic acid, decanoyloxy-p-benzene carboxylic acid, dodecanoyloxy-p-benzene sulfonic acid and salts thereof.

13. The foamed composition according to claim 11, wherein said liquid composition further comprises (f) a cationic surfactant, an amphoteric surfactant or mixtures thereof.

14. The foamed composition according to claim 1, wherein said liquid composition further comprises (g) 0 to 5 wt % of an anionic surfactant.

15. The foamed composition according to claim 1, wherein said liquid composition further comprises (h) 0.05 to 14 wt % of a dispersant.

16. The foamed composition according to claim 1, wherein said liquid composition further comprises (j) 0.005 to 5 mass % of a sequestering agent.

* * * * *